US005491937A

United States Patent [19]

Watson et al.

[11] Patent Number: 5,491,937

[45] Date of Patent: Feb. 20, 1996

[54] EARTHQUAKE ISOLATION BEARING

[75] Inventors: Ronald J. Watson, East Amherst; Paul F. Bradford, Amherst, both of N.Y.

[73] Assignee: R. J. Watson, Inc., East Amherst, N.Y.

[21] Appl. No.: 199,832

[22] Filed: Feb. 22, 1994

[51] Int. Cl.[6] ..... E04B 1/98; E04H 9/02

[52] U.S. Cl. ..... 52/167.8; 52/167.1; 52/167.4; 52/167.7; 248/581; 248/602

[58] Field of Search ..... 52/167.1, 167.4, 52/167.7, 167.8; 248/581, 602, 616, 632; 267/294

[56] References Cited

U.S. PATENT DOCUMENTS

| | | | |
|---|---|---|---|
| 1,022,858 | 4/1912 | Markus | 248/616 |
| 3,806,975 | 4/1974 | Fyfe | 14/16 |
| 3,921,240 | 11/1975 | Fyfe | 14/16 |
| 4,117,637 | 10/1978 | Robinson | 52/167 |
| 4,617,769 | 10/1986 | Fyfe et al. | 52/167 |

FOREIGN PATENT DOCUMENTS

| | | | |
|---|---|---|---|
| 1206981 | 7/1986 | Canada | 267/55 |
| 2336521 | 2/1975 | Germany | 248/581 |

OTHER PUBLICATIONS

Constantinou, M. C. et al, "Experimental and Theoretical Study of a Sliding Isolation System for Bridges," Technical Report NCEER-91-0027, Nov. 1991.

Constantinou, M. C. et al, "Sliding Isolation System for Bridges: Experimental Study," Earthquake Spectra, vol. 8, No. 3, 1992, pp. 321-344.

*Primary Examiner*—Carl D. Friedman
*Assistant Examiner*—W. Glenn Edwards
*Attorney, Agent, or Firm*—Michael L. Dunn

[57] ABSTRACT

A unitary compound earthquake isolation bearing which permits the installation of a compound bearing comprising a sliding bearing and at least one MER as a single unit without special and separate attachment of the MER to the support or superstructure.

13 Claims, 4 Drawing Sheets

EARTHQUAKE ISOLATION BEARING

BACKGROUND OF THE INVENTION

This invention relates to isolation bearings for man made structures and more particularly relates to such bearings used for isolation of earthquake shock and vibration to protect such structures.

Bridges and building structures, when subjected to earthquake movements, often incur significant structural damage. Much of this damage can be avoided if the structure is supported by bearings which allow the superstructure to move relative to the bearings. For instance, if a bridge superstructure rests upon sliding bearings, all ground motion will not be transferred to the superstructure. Decoupling of the structure from the ground is called base isolation.

Two key parts of an effective base isolation system is a damping force element and a restoring force element.

Bearings or supports for accommodating movements of superstructure due to thermal and other forces have been known for some time. Such supports in the form of sliding bearings are, for example, described in U.S. Pat. Nos. 3,806,975; 3,921,240. Additionally, lead-rubber bearings for earthquake isolation have been known, see e.g., U.S. Pat. No. 4,117,637. Sliding bearings, usually constitute support pads which under stress are free to move translationally or rotationally between a base support and the superstructure. Such sliding bearings have had a serious disadvantage in that there is minimum recovery to an original position or form. If, after encountering a shock or vibration such as produced by an earthquake, original relative positions of structural elements are not quickly reinstated, weakening of the structure and perhaps catastrophic failure may result. The restorative force of such sliding bearings unfortunately is not high.

It has been suggested that displacement control devices could be used to dampen relative movement between structural elements, e.g. a column and a superstructure such as a beam or girder used in a bridge. See e.g. Canadian Patent 1,206,981. Similar such devices have been tested at the National Center for Earthquake Engineering Research at the State University of New York at Buffalo. Results of such a test with respect to a bridge deck are shown in Table 1 below. A shock absorber device, e.g. similar to the one described in Canadian Patent 1,206,981 (a mass energy regulator, MER) was used in combination with a sliding bearing. The combination is referred to herein as a compound bearing. The compound bearing was compared with a traditional lead/rubber bearing and an elastomeric bearing. In Table 1, "X" corresponds to displacement in inches and "g" corresponds to acceleration in g's.

TABLE 1

| Peak | compound | | lead/rubber | | elastomeric | |
|---|---|---|---|---|---|---|
| acceleration | X | g | X | g | X | g |
| 0.2 g | 1.7 | 0.09 | 2.8 | 0.11 | 5.7 | 0.15 |
| 0.4 g | 2.4 | 0.18 | 5.2 | 0.24 | 11.4 | 0.29 |
| 0.6 g | 2.7 | 0.27 | 7.6 | 0.36 | 17.1 | 0.44 |

As can be seen from Table 1, the compound bearing transferred less than about 80% of the g force and between about 35 and 60% of the displacement of a lead/rubber bearing and about 60% of the g force and between about 15 and about 30% of the displacement of an elastomeric bearing. While such compound bearings clearly have merit, significant skill and engineering ability is required to properly install them so that they function properly in conjunction with a support bearing which is still required. Therefore in view of the skill that is required for installation, faulty installation by unskilled workers and even skilled workers is possible and even likely.

BRIEF DESCRIPTION OF THE INVENTION

Figure 1:
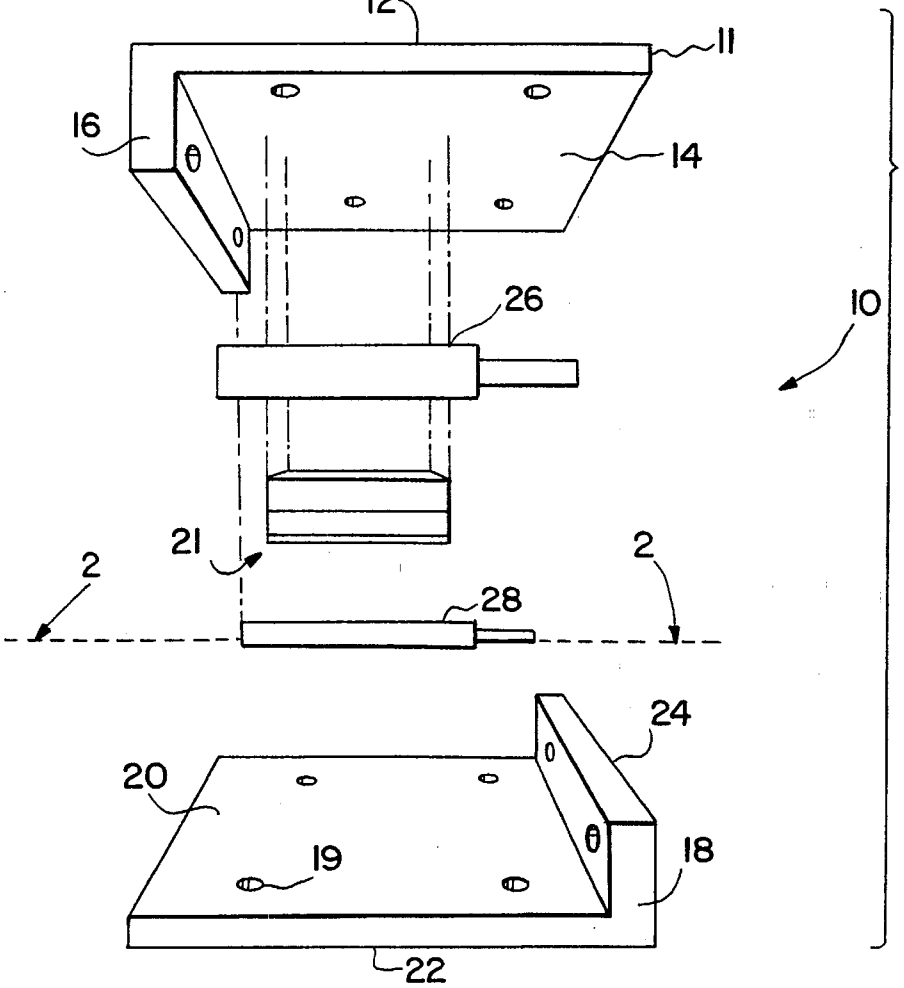
FIG. 1 shows an exploded perspective view of a preferred embodiment of the unitary compound earthquake isolation bearing of the invention, with swivel connecting means omitted.

In accordance with the present invention there is provided a unitary compound earthquake isolation bearing. The unitary compound bearing of the invention may take many forms but in all forms permits the installation of a compound bearing comprising a sliding bearing and at least one MER as a single unit without special and separate attachment of the MER to the support or superstructure.

In a preferred embodiment, the earthquake isolation bearing comprises:

a) an upper bearing plate having an upper surface, a lower surface, and a connecting means which downwardly extends from its lower surface;

b) a lower bearing plate having an upper surface, a lower surface, and a connecting means which upwardly extends from its upper surface;

c) at least one and more preferably at least two mass energy regulators horizontally connected between said connecting means; and d) a bearing element located between the lower surface of the upper bearing plate and the upper surface of the lower bearing plate, between the mass energy regulators and between the upper and lower bearing plate connecting means.

The bearing element preferably comprises an elastomeric pad, the connecting means of the upper bearing plate preferably is a flange which extends from the upper bearing plate proximate an edge of the upper bearing plate and the connecting means of the lower bearing plate preferably is a flange which extends from the lower bearing plate proximate an edge of the lower bearing plate.

In the unitary compound bearing of the invention the mass energy regulators are usually, but not necessarily, connected to the connecting means with bolts and the mass energy regulators each comprise a spring which provides a force to restore an original relative position of the upper and lower bearing plates after a relational displacement of the plates and which may provide frictional elements which provide vibrational damping.

The mass energy regulators usually each comprise a spring arranged so that motion of the connecting means toward or away from each other compresses the spring which compression tends to restore the original relative position of the connecting means.

DETAILED DESCRIPTION OF THE INVENTION

The unitary compound earthquake isolation bearing of the invention has numerous advantages over previously known isolation bearings. In particular the unitary compound isolation bearing of the invention is simpler to install than any prior compound bearing system thus reducing costs of installation and risks of improper installation. It has been established by tests that the bearing of the invention will continue to perform after thousands of cycles thus increasing reliability and reducing the need for frequent inspection. The compound bearing of the invention is designed to restore the structure to its original pre-quake condition thus reducing maintenance and repair requirements. For typical highway bridges, the compound bearing of the invention is only about one foot long and weighs as little as one-hundred pounds thus making the compound bearing of the invention easier to handle than separate components. Because the compound bearing of the invention is so effective in reducing forces and displacements, structural elements can actually be made smaller thus reducing construction cost. The compound bearing of the invention is versatile and can be readily modified or adjusted to fit varying requirements. And because the unitary compound bearing of the invention is so small, it can be readily attached to existing bearings to dramatically increase their performance.

The sliding bearing is usually comprised of a bearing element or pad of an elastomeric material, between two bearing plates of a material such as stainless steel and may further comprise special sliding surfaces. The sliding bearing supports essentially all of the vertical forces applied to the bearing. The MER's of the unitary bearing of the invention have at least two functions. One of the functions of the MER is to provide a restoring force, usually by an elastomeric spring. The chief function of this spring is to help push or pull the structure back to its pre-earthquake position. A small amount of viscous damping may also be provided by the spring.

The MER may also contain a frictional brake. The sliding interface of this brake, though typically composed of bronze and stainless steel, may also be composed of other friction couples such as steel-steel or plastic-steel. Friction may be increased by tightening down a bolt to apply pressure to the brake interface. A small stiff spring can be attached in series with the bolt to allow wear of the braking surfaces without significant loss of braking force.

The MER may be composed of two separate chambers. The first chamber may contain the spring unit while the second chamber contains the brake unit. If damping from the friction of the sliding bearing alone is adequate in the particular isolation situation, the brake chamber may be left empty.

The MER's are connected at one end to the masonry, base or lower plate and at the other end to the sliding, sole or upper plate. The two plates, as above described, are most commonly referred to herein as the upper plate and lower plate respectively. Each connection can rotate (pivot) and translate such that bearing movements in the longitudinal, transverse and vertical directions can be accommodated. The positioning of the MER's allows for the even distribution of forces to the anchoring systems above and below the bearing.

To further facilitate the understanding of the invention reference may be had to the drawings which illustrate a preferred embodiment of the invention. It is to be understood that the preferred embodiment is for the purpose of illustrating and not limiting the invention.

Figure 2:
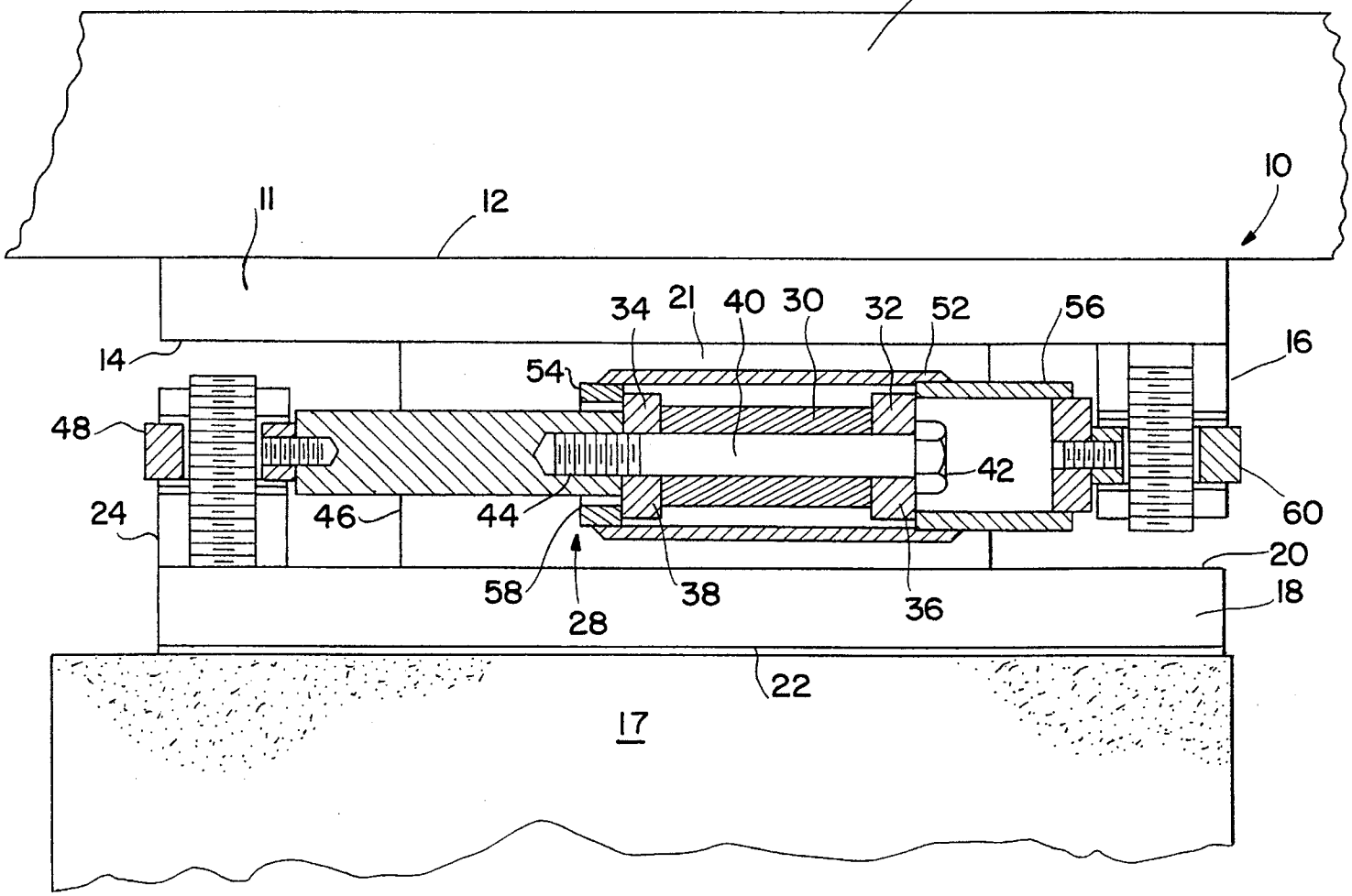
FIG. 2 is a cross sectional view of the embodiment of FIG. 1 taken along line 2—2 of FIG. 1 when the bearing is assembled.
Figure 3A:
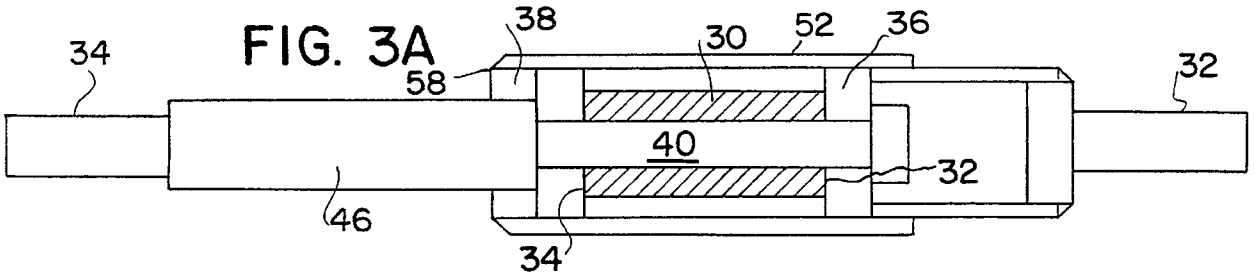
FIG. 3*a* is a cross sectional view of a preferred embodiment of an MER used in the unitary bearing of the invention.
Figure 3B:
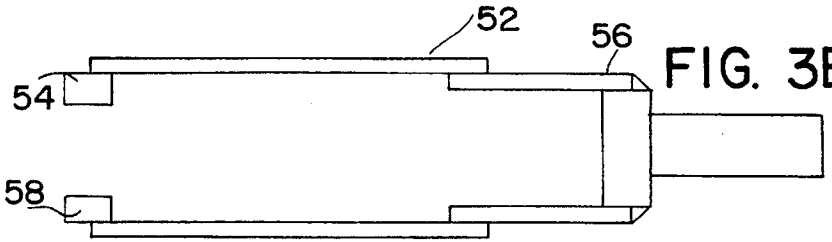
FIG. 3*b* is a view of the housing or cylinder of the MER shown in FIG. 3*a*.
Figure 3C:
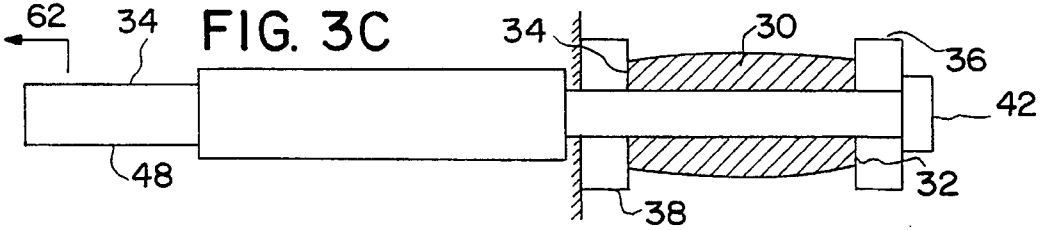
FIG. 3*c* is a cross sectional view of the spring and pull bolt of the MER of FIG. 3*a* showing compression of spring 30 when the base plate moves in the direction of arrow 62.
Figure 3D:
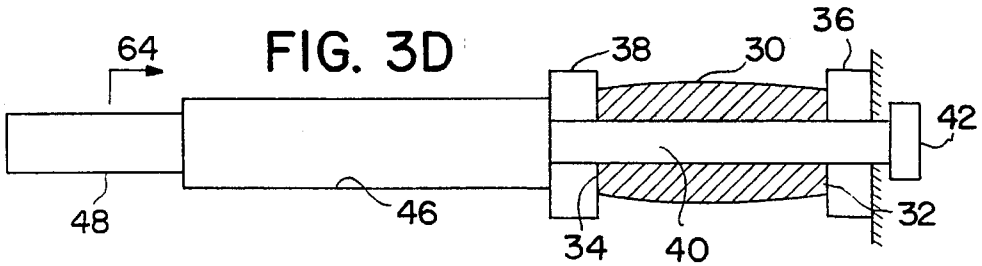
FIG. 3*d* is a cross sectional view of the spring and pull bolt of the MER of FIG. 3*a* showing compression of spring 30 when the base plate moves in the direction of arrow 64.
Figure 4:
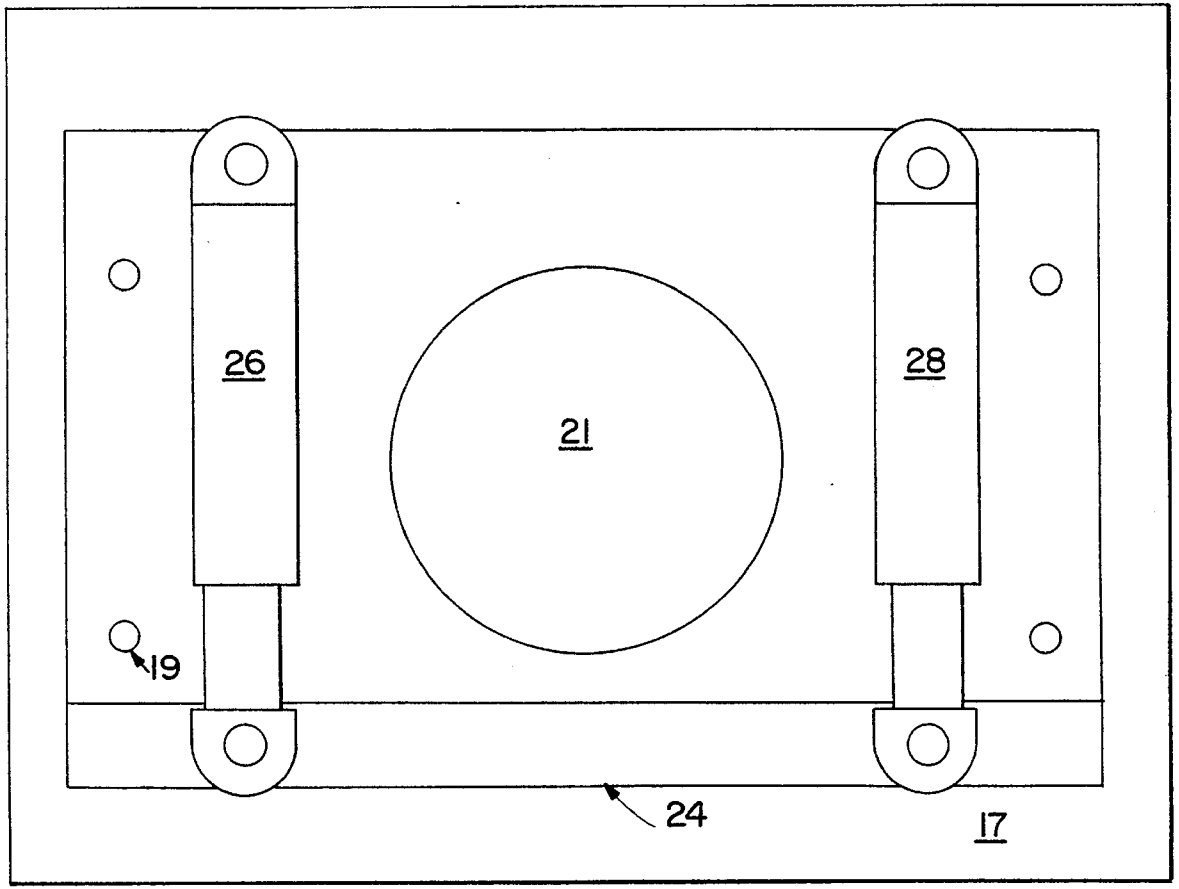
FIG. 4 is a cross sectional top view of a preferred embodiment of the unitary isolation bearing of the invention as viewed downwardly from beneath the upper bearing plate.

As seen in FIG. 1, which shows an exploded view of the unitary compound bearing of the invention, the bearing 10 comprises an upper bearing plate 11 having an upper surface 12 and a lower surface 14 and a connecting means 16 which downwardly extends from lower surface 14 and is usually a flange. Bearing 10 further comprises a lower bearing plate 18 having an upper surface 20, a lower surface 22 and a lower bearing plate connecting means 24 which upwardly extends from lower bearing plate upper surface 20. The upper surface 12 of upper bearing plate 11 supports a superstructure 15 which may for example be a beam. As seen in FIG. 2, the lower surface 22 rests on a base 17 which may for example be a column, pier or abutment. The bearing plates may be secured to the respective base and superstructure by placing anchor bolts through holes 19.

A bearing pad 21, acting as a sliding bearing which bears essentially all vertical forces applied to the unitary compound bearing 10, is located between and engages the lower surface 14 of the upper bearing plate and the upper surface 20 of the lower bearing plate.

As shown in the preferred embodiment illustrated in FIG. 1, two mass energy regulators 26 and 28 are provided, preferably on opposite sides of sliding bearing 21. As best seen in FIGS. 2, 3*a*, 3*c* and 3*d*, each mass energy regulator comprises a spring 30 having opposite ends 32 and 34 and first and second pull plates 36 and 38 abutting the first and second ends 32 and 34 respectively. The spring 30 may be of a suitable elastomeric material.

Means is provided for maintaining the original relationship of the first pull plate 36 relative to the first connecting means 16, but not to the second connecting means 24, and the original relationship of the second pull plate 38 relative to the second connecting means 24, but not to the first connecting means 16, when the connecting means 16 and 24 move toward each other so that as a result of said toward motion the pull plates 36 and 38 move closer together to compress the spring 30; and means for maintaining the original relationship of the first pull plate 36 relative to the second connecting means 24, but not to the first connecting means 16, and the original relationship of the second pull plate 38 relative to the first connecting means 16, but not to the second connecting means 24, when the connecting means 16 and 24 are moved away from each other so that as a result of said away motion the pull plates 36 and 38 again move toward each other to compress the spring 30.

In the embodiment of the invention shown in the drawings, the means for maintaining the original relationship of the first pull plate 36 to the second connecting means 24 during said away motion comprises a bolt 40 having a head end 42 and a thread end 44 and passing through the first pull plate 36, the spring 30, and the second pull plate 38 so that the head end 42 abuts the first pull plate 36, the threaded end 44 being interconnected by means of rod 46 and swivel connector 48 to the second connecting means 24 so that motion of the second connecting means 24 away from the first connecting means 16 causes the head end 42 of the bolt 40 to pull the first pull plate 36 thus maintaining the distance between the first pull plate 36 and the second connecting means 24.

In the preferred embodiment shown in the drawings, the means for maintaining the original relationship of the second pull plate 38 to the first connecting means 16 during said away motion, represented by arrow 62, comprises a cylinder 52 having first and second cylinder ends 54 and 56, said cylinder 52 encasing the spring 30 and pull plates 36 and 38 said cylinder 52 having a cylinder end plate 58 at its first end 54 which abuts the second pull plate 38, the second end of the cylinder 52 being interconnected to the first connecting means 16 by means of swivel connector 60 so that motion of the second connecting means 24 away from the first connecting means 16 causes the end plate 58 of the cylinder 52 to pull the second pull plate 38 thus maintaining the distance between the second pull plate 38 and the first connecting means 16.

Damping friction may be provided, for example by means of a frictional interface forming a brake between pull plates 36 and 38 and cylinder 52.

In operation, when the ground begins to shake, the base plate 18 moves accordingly, i.e. with the bent. The base plate connections pull at rod or shaft 46, which transfers the load to the pull bolts 40 in each MER. The pull bolt in turn pulls the pull plate 36, which compresses spring 30. Displacement occurs at the sliding bearing 21 and the brake, if present, which provides a damping force to the structure above. As the ground starts to move in the opposite direction, the compression in the spring is released and the shaft pushes on the pull plate 38, which again compresses the spring. In this manner the spring loads and unloads to provide the necessary restoring force to the structure while energy is dissipated by the frictional surfaces.

What is claimed is:

1. An earthquake isolation bearing comprising:

a) an upper bearing plate having an upper surface, a lower surface, and a connecting means which downwardly extends from its lower surface;

b) a lower bearing plate having an upper surface, a lower surface, and a connecting means which upwardly extends from its upper surface;

c) at least two mass energy regulators horizontally connected between said connecting means; and d) a bearing element located between the lower surface of the upper bearing plate and the upper surface of the lower bearing plate, between the mass energy regulators and between the upper and lower bearing plate connecting means said upper bearing plate, said lower bearing plate, said mass energy regulators and said bearing element being assembled to permit handling and installation of the isolation bearing as a single unit.

2. The isolation bearing of claim 1 wherein the bearing element comprises an elastomeric pad.

3. The bearing of claim 1 wherein the connecting means of the upper bearing plate is a flange which extends from the upper bearing plate proximate an edge of the upper bearing plate.

4. The bearing of claim 1 wherein the connecting means of the lower bearing plate is a flange which extends from the lower bearing plate proximate an edge of the lower bearing plate.

5. The bearing of claim 1 wherein the mass energy regulators are connected to the connecting means with bolts.

6. The bearing of claim 1 wherein the mass energy regulators each comprise a spring which provides a force to restore an original relative position of the upper and lower bearing plates after a relational displacement of the plates.

7. The bearing of claim 6 wherein the mass energy regulators each comprise a spring arranged so that motion of the connecting means toward or away from each other compresses the spring which compression tends to restore the original relative position of the connecting means.

8. The bearing of claim 7 wherein the mass energy regulators each comprise a spring having first and second opposite ends, first and second pull plates abutting said first and second ends respectively, means for maintaining the original relationship of the first pull plate relative to the first connecting means, but not to the second connecting means, and the original relationship of the second pull plate relative to the second connecting means, but not to the first connecting means, when the connecting means move toward each other so that as a result of said toward motion the pull plates move closer together to compress the spring; and means for maintaining the original relationship of the first pull plate relative to the second connecting means, but not to the first connecting means, and the original relationship of the second pull plate relative to the first connecting means, but not to the second connecting means, when the connecting means are moved away from each other so that as a result of said away motion the pull plates again move toward each other to compress the spring.

9. The bearing of claim 8 wherein the means for maintaining the original relationship of the first pull plate to the second connecting means during said away motion comprises a bolt having a head end and a thread end and passing through the first pull plate, the spring, and the second pull plate so that the head end abuts the first pull plate, the threaded end being interconnected to the second connecting means so that motion of the second connecting means away from the first connecting means causes the head end of the bolt to pull the first pull plate thus maintaining the distance between the first pull plate and the second connecting means.

10. The bearing of claim 9 wherein the means for maintaining the original relationship of the second pull plate to the first connecting means during said away motion comprises a cylinder having first and second ends, said cylinder encasing the spring and pull plates, said cylinder having an end plate at its first end which abuts the second pull plate, the second end of the cylinder being interconnected to the first connecting means so that motion of the second connecting means away from the first connecting means causes the end plate of the cylinder to pull the second pull plate thus maintaining the distance between the second pull plate and the first connecting means.

11. The bearing of claim 1 wherein the springs are made of an elastomeric material.

12. The bearing of claim 6 wherein the mass energy regulators include frictional elements which provide vibrational damping.

13. The bearing of claim 12 wherein the friction is provided by means of a frictional interface within a cylinder enclosing the spring.

* * * * *